US008047415B2

(12) United States Patent
Kunz et al.

(10) Patent No.: US 8,047,415 B2
(45) Date of Patent: Nov. 1, 2011

(54) FLYWHEEL DRIVEN FASTENER DRIVING TOOL HAVING RETRACTABLE NOSE ASSEMBLY

(75) Inventors: Michael Kunz, Dorndorf (DE); Stefan D. Gensmann, Fruecht (DE); Markus Rompel, Runke/Schadeck (DE)

(73) Assignee: Black & Decker Inc., Newark, DE (US)

( * ) Notice: Subject to any disclaimer, the term of this patent is extended or adjusted under 35 U.S.C. 154(b) by 176 days.

(21) Appl. No.: 12/475,064

(22) Filed: May 29, 2009

(65) Prior Publication Data

US 2009/0294505 A1 Dec. 3, 2009

(30) Foreign Application Priority Data

May 30, 2008 (GB) ..... 0809868.3
Aug. 22, 2008 (GB) ..... 0815284.5

(51) Int. Cl.
*B25C 1/06* (2006.01)

(52) U.S. Cl. ..... 227/8; 227/131; 227/123; 227/129

(58) Field of Classification Search ..... 227/8, 131, 227/123, 129
See application file for complete search history.

(56) References Cited

U.S. PATENT DOCUMENTS 4,042,036 A 8/1977 Smith et al.
4,121,745 A 10/1978 Smith et al.
4,189,080 A * 2/1980 Smith et al. ..... 227/8
4,204,622 A * 5/1980 Smith et al. ..... 227/7
4,323,127 A 4/1982 Cunningham
4,558,747 A 12/1985 Cunningham
4,964,558 A * 10/1990 Crutcher et al. ..... 227/8
5,511,715 A * 4/1996 Crutcher et al. ..... 227/131
2006/0091177 A1* 5/2006 Cannaliato et al. ..... 227/8
2008/0006419 A1* 1/2008 Harcar et al. ..... 173/114
2008/0006426 A1* 1/2008 Friedrich et al. ..... 173/210
2008/0308592 A1* 12/2008 Schell et al. ..... 227/8
2009/0236387 A1* 9/2009 Simonelli et al. ..... 227/8
2009/0294502 A1* 12/2009 Kunz et al. ..... 227/2
2009/0294504 A1* 12/2009 Kunz et al. ..... 227/8
2009/0294507 A1* 12/2009 Kunz et al. ..... 227/120
2009/0294508 A1* 12/2009 Kunz et al. ..... 227/131

OTHER PUBLICATIONS

Matzdorf, Udo—European Search Report—Oct. 12, 2009—The Hague.

* cited by examiner

*Primary Examiner* — Brian D Nash
(74) *Attorney, Agent, or Firm* — Rhonda Barton; Adan Ayala

(57) ABSTRACT

A fastener driving tool arranged to drive fasteners into a workpiece includes a support, at least one wheel movably mounted on the support, a driver arranged to contact and he guided by the wheel when the wheel is in an operative position in use, a nose part retractable relative to the support, and a connection mechanism to operatively interconnect the nose part with the wheel. The tool is arranged such that, in use, the retraction of the nose part causes the connection mechanism to move the wheel from an inoperative position to the operative position. Subsequent forward movement of the driver guided by the wheel toward the nose part causes the operative interconnection between the nose part and the wheel to be broken. Forward movement of the nose part relative to the support, subsequent to the operative interconnection between the nose part and the wheel being broken, causes the operative interconnection between the nose part and the wheel to be re-formed.

22 Claims, 10 Drawing Sheets

FLYWHEEL DRIVEN FASTENER DRIVING TOOL HAVING RETRACTABLE NOSE ASSEMBLY

BACKGROUND OF THE INVENTION

1. Field of the Invention

The present invention relates to fastener driving tools, particularly such tools in which the fasteners comprise nails. Thus, the tool according to the invention may comprise a nailer. However, the invention also concerns fastener driving tools for other types of fasteners, including pins, staples, etc.

2. Description of the Related Art

U.S. Pat. No. 4,042,036 discloses an impact tool having two flywheels arranged to propel an impact ram, to drive nails from the tool. Each flywheel is powered by its own respective motor, located adjacent thereto. One flywheel and its motor have a fixed rotational axis, whereas the other flywheel and its motor have a movable rotational axis which is arranged to pivot about an axis located on the opposite side of the motor/flywheel to that of the fixed motor/flywheel. The flywheel having a movable rotational axis can thus be moved toward and away from the other flywheel, to engage with, and disengage from, the ram.

U.S. Pat. No. 4,121,745 also discloses an impact tool having two flywheels arranged to propel an impact ram, to drive nails from the tool. A single mains powered AC electric motor powers both of the flywheels, by means of a belt which is driven by the rotor shaft of the motor. One of the flywheels has a fixed rotational axis, and the other flywheel has a movable rotational axis which allows that flywheel to be moved toward and away from the other flywheel, to engage with, and disengage from, the ram. The movable flywheel is pushed directly toward the fixed flywheel by means of a cam rod, and moves back directly away from the fixed flywheel under the influence of a compression spring.

U.S. Pat. No. 4,323,127 also discloses an impact tool having two flywheels arranged to propel an impact ram, to drive nails from the tool. Each flywheel is powered by a respective electric motor situated adjacent thereto, and each flywheel and its respective motor is pivotable about an axis located on the opposite side of the motor/flywheel to that of the other motor flywheel. The flywheels and motors are pivoted toward each other by means of solenoids when the user pulls a trigger of the tool. The flywheels and motors pivot away from each other under the influence of springs.

U.S. Pat. No. 4,558,747 also discloses an impact tool having two flywheels arranged to propel an impact ram, to drive nails from the tool. A single motor powers both of the flywheels, by means of a gearing and pulley mechanism. Each flywheel is arranged to pivot toward and away from the other flywheel about a respective pivot point located such that a plane joining the pivot point and the rotational axis of the flywheel is approximately perpendicular to a plane in which the two axes of rotation of the flywheels lie.

BRIEF SUMMARY OF THE INVENTION

The present invention seeks to provide a fastener driving tool with an improved fastener driving arrangement.

A first aspect of the present invention provides a fastener driving tool, comprising: a support; at least one wheel movably mounted on the support; a driver arranged to contact and be guided by the wheel when the wheel is in an operative position in use; a nose part retractable relative to the support; and a connection mechanism to operatively interconnect the nose part with the wheel; the tool arranged such that, in use, the retraction of the nose part causes the connection mechanism to move the wheel from an inoperative position to the operative position, and subsequent forward movement of the driver guided by the wheel toward the nose part causes the operative interconnection between the nose part and the wheel to be broken.

An advantage of the invention is that because the nose part must be retracted in order to cause the tool to be operative, and because the forward movement of the driver causes the operative interconnection between the nose part and the wheel to be broken (i.e. disconnected or disengaged), the tool must be "re-set" after a fastener is driven from the tool into a workpiece—i.e. the operative interconnection between the nose part and the wheel must be re-formed—before another fastener can be driven from the tool. Thus, the mechanical arrangement of the invention provides a fastener driving tool with a particularly effective mechanism. This will be described in detail herein.

The wheel may comprise a guide wheel for the driver, e.g. arranged to act in conjunction with one or more flywheels. However, in preferred embodiments of the invention, the wheel includes a flywheel arranged to propel the driver toward the nose part, to drive a fastener from the tool into a workpiece. The driver preferably includes a ram or impact member as a component thereof, which ram or impact member is arranged to contact a fastener (e.g. a nail) held in the tool, to drive the fastener from the tool into a workpiece.

Preferably, the wheel is pivotally mounted on the support, and the movement of the wheel from its inoperative position to its operative position includes pivoting movement with respect to the support.

The breaking of the operative interconnection between the nose part and the wheel preferably causes or allows the wheel to be moved from the operative position to the inoperative position. Preferably, the tool includes at least one resilient member arranged to cause the wheel to be moved from the operative position to the inoperative position when the operative interconnection between the nose part and the wheel is broken.

The driver may be arranged to return to a starting position after it has driven a fastener from the tool, and the movement of the wheel from the operative position to the inoperative position preferably allows the driver to return to its starting position substantially without touching the wheel. The return of the driver to a rear starting position may, for example, be achieved by means of one or more resilient components pulling and/or pushing the driver to the rear of the tool. The resilient component(s) may, for example, comprise one or more elastically deformable components, e.g. an elastomeric cord and/or a helical spring.

In preferred embodiments of the invention, the connection mechanism includes at least first and second parts arranged such that when the connection mechanism provides the operative interconnection between the nose part and the wheel, the first and second parts are directly or indirectly in engagement with each other, and when the operative interconnection is broken, the first and second parts are disengaged from each other. Preferably, the tool is arranged such that the first and second parts are disengaged from each other, in use, by the driver forcing them to become disengaged by virtue of its forward movement. For example, the driver may be arranged to impact at least a portion of the first part of the connection mechanism during the driver's forward movement, thereby disengaging the first part from the second part. Preferably, at least the portion of the first part of the connection mechanism is arranged to move (e.g. rotate) relative to the second part when impacted by the driver.

The engagement between the first and second parts of the connection mechanism may, for example, comprise at least a component of one of the parts being located in a recess or opening in the other part. The disengagement of the first and second parts may comprise the component or part not being located in the recess or opening in the other part.

In some preferred embodiments of the invention, the tool may include two sets of first and second parts of the connection mechanism, for example located on opposite sides of a longitudinal axis of the tool.

Preferably, the tool includes a pair of the wheels (e.g. flywheels) arranged such that the driver contacts and passes between the wheels during its forward movement toward the nose part when the wheels are in their operative position in use. Preferably, the movement of the wheels (e.g. flywheels) from their operative position to their inoperative position allows the driver to return to its starting position by passing back between the wheels.

Preferably, the wheel (e.g. flywheel) is rotationally mounted on a respective frame, the frame movably mounted on the support. The tool preferably includes at least one motor arranged to power the flywheel. Advantageously, each flywheel may be powered by a respective motor, and each flywheel and its associated motor may be mounted on a respective frame which is movably mounted on the support. The motor, flywheel and frame preferably comprise a sub-assembly, and the movement of the flywheel between its inoperative and operative positions preferably includes movement (e.g. pivoting) of the sub-assembly with respect to the support. Advantageously, the sub-assemblies may be movably (e.g. pivotally) mounted on the support at mounting (e.g. pivot) points that, at least when the nose part has been retracted, are situated closer to the nose part than are the rotational axes of the wheels. Preferably, the sub-assemblies are movably mounted on the support at mounting points that are situated generally between the sub-assemblies. The sub-assemblies preferably are resiliency biased away from each other, for example by means of at least one spring member.

In preferred embodiments of the invention, the tool is arranged such that forward movement of the nose part relative to the support, subsequent to the operative interconnection between the nose part and the wheel being broken, causes the operative interconnection between the nose part and the wheel to be re-formed.

Accordingly, a second aspect of the invention includes a fastener driving tool, including: a support; at least one wheel movably mounted on the support; a driver arranged to contact and be guided by the wheel when the wheel is in an operative position in use; a nose part retractable relative to the support; and a connection mechanism to operatively interconnect the nose part with the wheel; the connection mechanism having an operative mode in which the nose part and the wheel are operatively interconnected, and an inoperative mode in which the nose part and the wheel are not operatively interconnected; the tool arranged such that, when the connection mechanism is in its inoperative mode and the nose part is retracted, forward movement of the nose part away from the support causes the connection mechanism to adopt its operative mode.

It is to be understood that any feature of any aspect of the invention may be a feature of any other aspect of the invention.

The re-forming of the operative interconnection between the nose part and the wheel may be achieved, for example, by first and second parts of the connection mechanism re-engaging with each other when the nose part moves forward relative to the support when the connection mechanism is in its inoperative mode. As mentioned above, the engagement between the first and second parts of the connection mechanism may, for example, comprise at least a component of one of the parts being located in a recess or opening in the other part. A movable member (e.g. a resiliently movable member) may be located at least partially across the recess or opening in order to prevent inadvertent re-engagement until the forward movement of the nose part, for example.

In preferred embodiments, the tool includes at least one resilient part arranged to move the first and/or second part of the connection mechanism to a rest position when the nose part moves forward, thereby re-engaging the first and second parts with each other.

Advantageously, each flywheel may comprise a component of its associated motor. Preferably, each motor includes a stator and a rotor, and each flywheel preferably includes at least part of the rotor of its associated motor. Advantageously, each motor may comprise a brushless motor. The flywheel part of the rotor may comprise a component that is separate from the remainder of the rotor and attached thereto. Alternatively, the flywheel part of the rotor and the remainder of the rotor may comprise a single piece. Advantageously, the flywheel part of the rotor may comprise a part extending at least partially beyond the stator in a direction along an axis of rotation of the rotor about the stator. Preferably, the flywheel part of the rotor includes an external surface of the rotor. The stator of the (or each) motor preferably includes a core and windings, and the motor preferably further includes an axial shaft on which the stator is mounted. The motor preferably includes at least one bearing, and preferably, two or more bearings, located between the rotor and the shaft, on which the rotor rotates. The rotor preferably includes one or more permanent magnets, for example a plurality of permanent magnets spaced apart from each other and located on an internal surface of the rotor facing the stator.

Each motor may be a so-called DC (direct current) brushless motor or an AC (alternating current) brushless motor. Such motors are disclosed in, for example U.S. Pat. No. 4,882,511, the entire disclosure of which is incorporated herein by reference. Consequently, the electrical structure and functioning of such motors will not be described in detail herein. As persons skilled in the art of electrical motors know, a "DC brushless motor" has this name because it is substantially equivalent to a conventional direct current brushed motor, but instead of the stator providing a permanent magnetic field and the rotor having windings, as is the case in a conventional DC brushed motor, in a DC brushless motor the stator has the windings and the rotor provides the permanent magnets. However, this brushless arrangement also requires that the electrical current provided to the motor be reversed at defined rotational positions of the rotor with respect to the stator. Consequently, a so-called "DC brushless motor" is actually or effectively powered by AC electrical current, and thus it is sometimes called an "AC brushless motor".

In the present invention, each motor preferably is a brushless motor that is powered by poly-phase (multi-phase) alternating current. Most preferably, each motor is powered by three-phase alternating current. The electrical power for the tool may be provided by AC mains power and/or DC battery power, especially by means of one or more rechargeable batteries. The tool preferably includes one or more motor controllers including drive electronics to drive and control the motors, and such controller(s) may convert the AC or DC source electrical current into the appropriate current for powering and controlling the motors. Each motor may, for example, utilize one or more sensors, e.g. Hall effect sensors, to sense the rotational position, and preferably rotational speed, of the rotor with respect to the stator over time. Additionally or alternatively, the tool may utilize EMF (electromotive force) feedback to monitor the rotational position, and preferably rotational speed, of the rotors. At least in the broadest aspects of the invention, any suitable system of control for the motors may be used. Such control systems, including systems that utilize sensors and/or EMF feedback, are well known to persons skilled in the art of electrical motors, and will not be described in detail herein.

As already indicated, the fastener driving tool according to the invention preferably is a nailer, the fasteners driven by the tool being nails.

BRIEF DESCRIPTION OF THE DRAWINGS

Embodiments of the invention will now be described, by way of example, with reference to the accompanying drawings, of which.

DETAILED DESCRIPTION OF THE INVENTION

Figure 1:
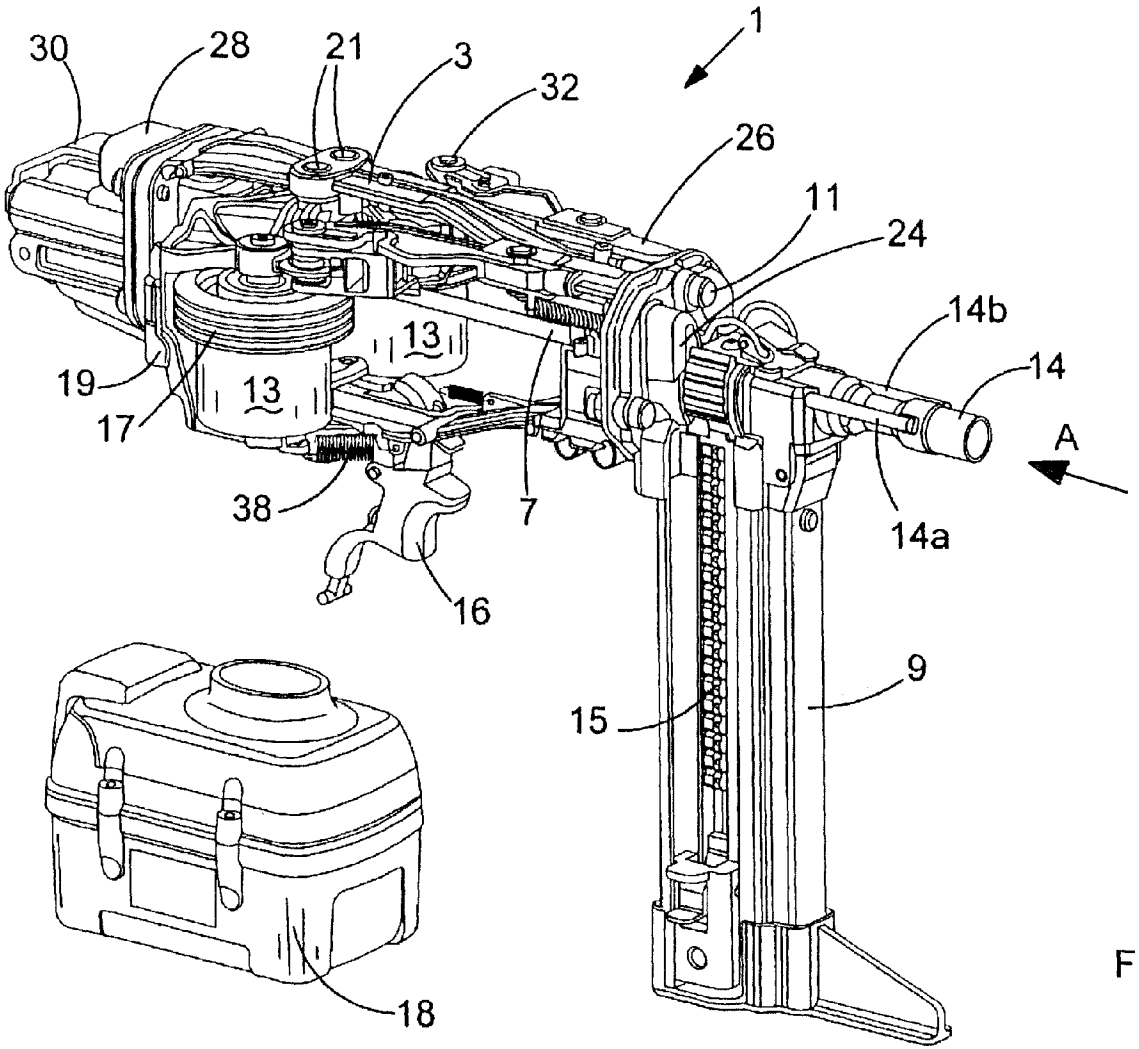
FIGS. 1 to 7 show a first embodiment of a fastener driving tool according to the invention, and components thereof.
Figure 2:
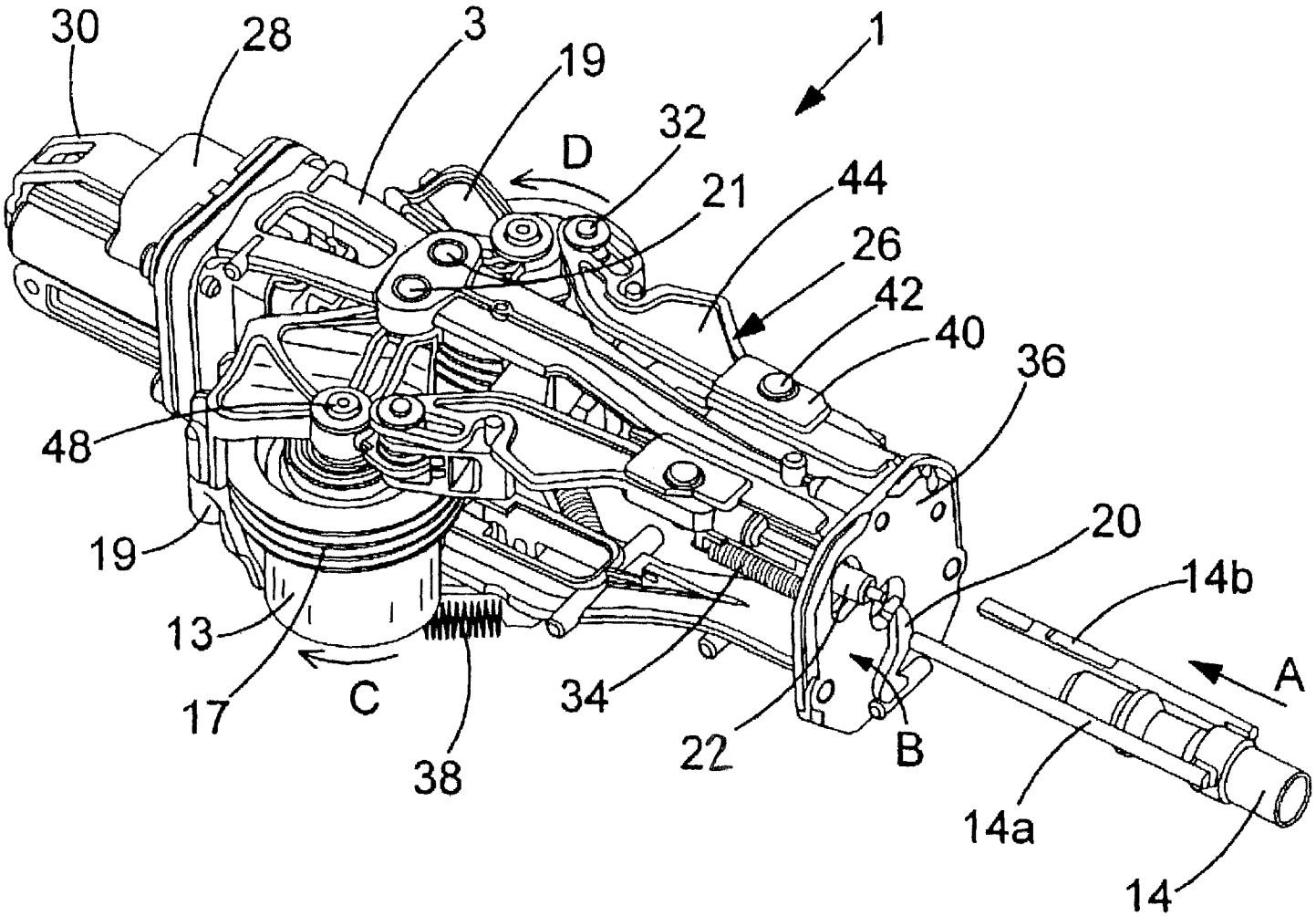
Figure 3:
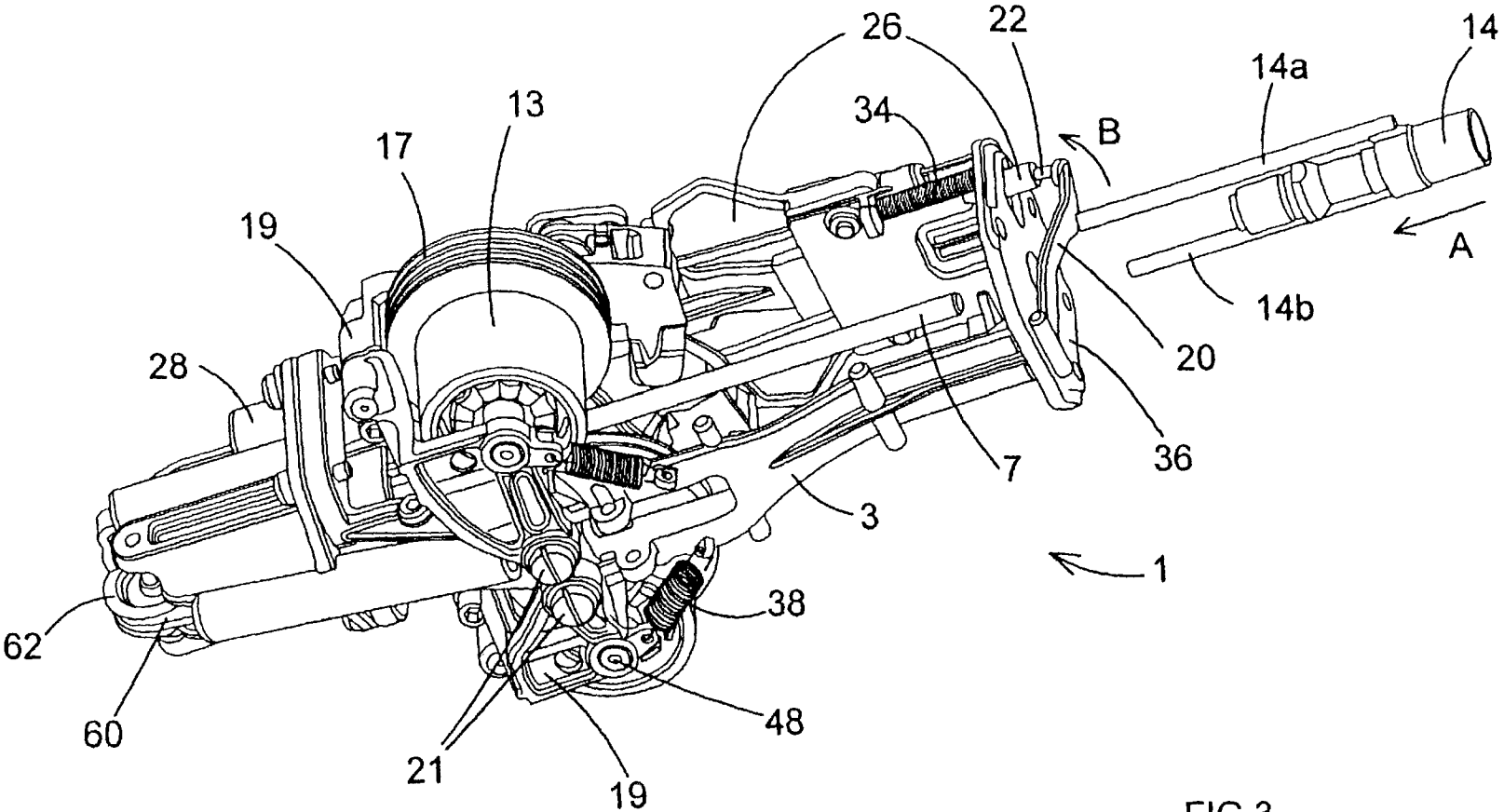
Figure 4:
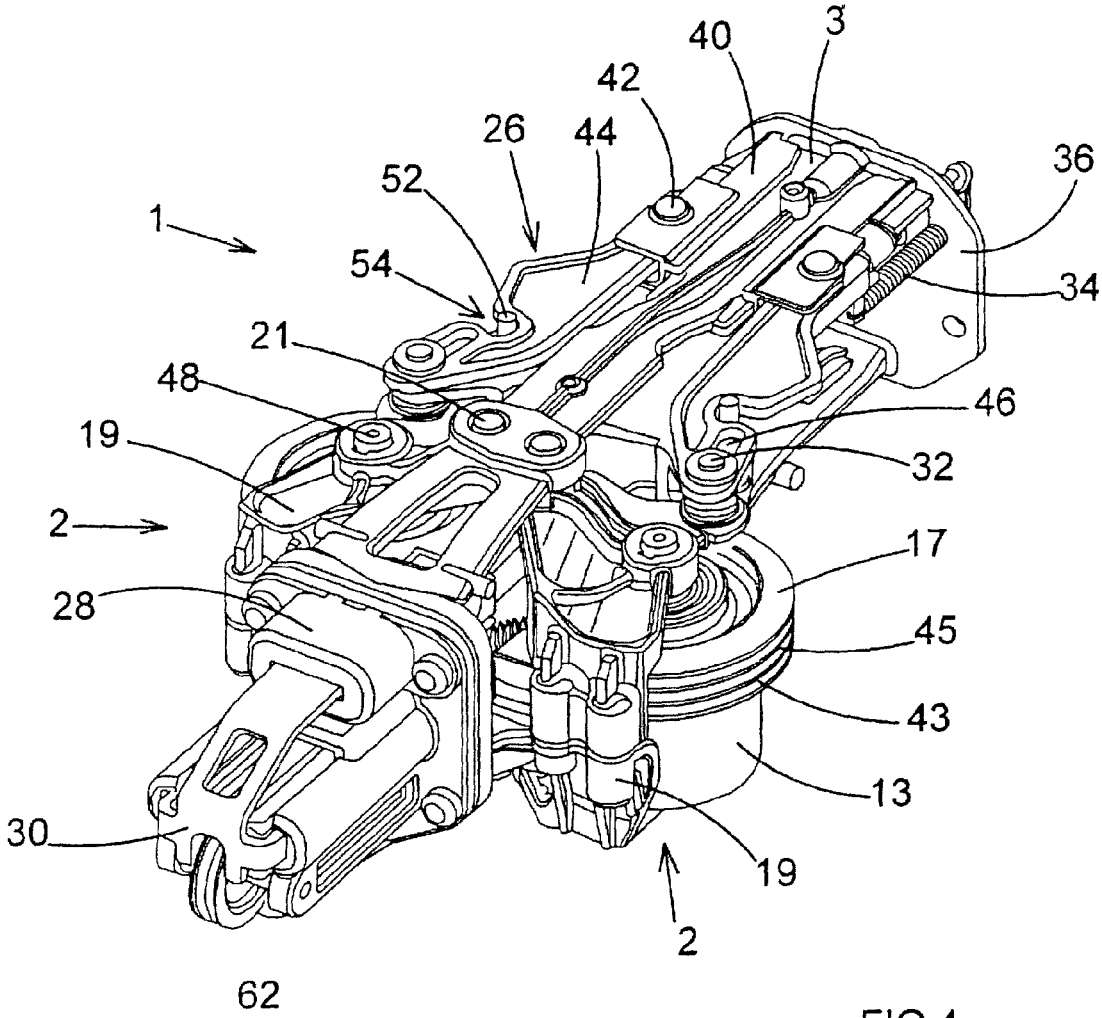
Figure 5:
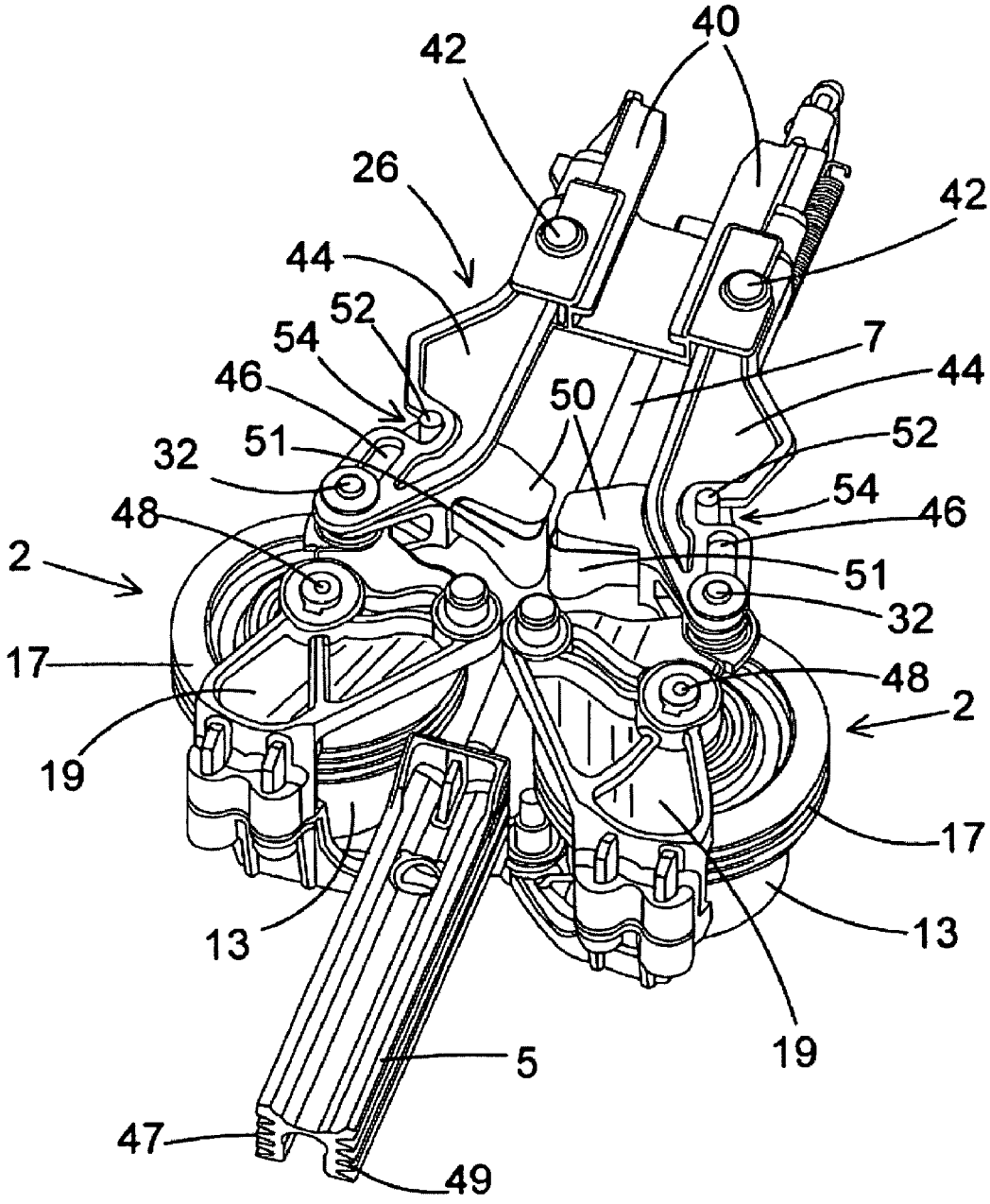
Figure 6:
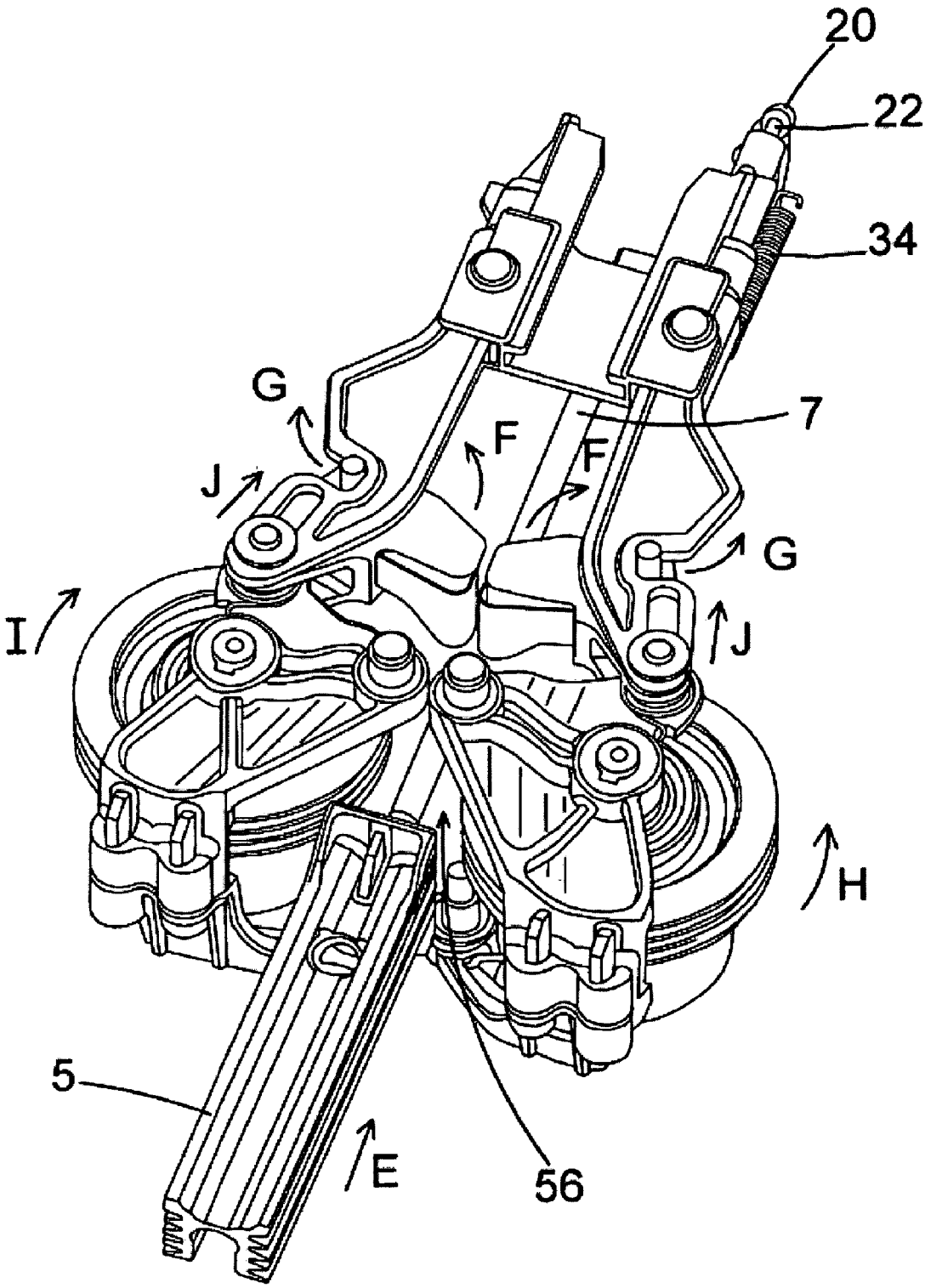

FIGS. 1 to 7 show a fastener driving tool 1 according to the invention, and various components thereof, including a support 3, a driver 5 and a ram 7, the ram being attached to a front part of the driver, and a fastener supply assembly 9 attached to a front part of the support 3, for example by means of screws 11. FIG. 1 shows the main components of the fastener driving tool 1, including two electric motors 13 having integral flywheels 17 arranged to be contacted by the driver 5 and to propel the driver and ram 7 toward a resiliently retractable nose part 14 of the fastener supply assembly 9 of the of the tool, to drive a fastener from the tool into a workpiece. In the embodiment of the tool shown in the Figures, the fasteners are nails 15, and the tool is a nailer. The fastener driving tool 1 includes a handle (not shown), a trigger 16 for firing the tool, and a rechargeable and removable battery 18 for powering the motors 13.

The fastener driving tool 1 is arranged such that when a user wishes to drive or fire a fastener (e.g. a nail 15) into a workpiece (not shown), the user pushes the nose part 14 of the tool against the workpiece, causing the nose part to retract (in the direction of arrow A) with respect to the support 3. The nose part 14 includes two elongate parts 14*a* and 14*b* which extend rearwards (i.e. in the direction of arrow A) from the front of the nose part. The retraction of the nose part 14 causes elongate part 14*a* to rotate a lever 20 as indicated by arrow B (see FIGS. 2 and 3) mounted in a front housing part 24, against a spring bias. The rotation of the lever 20 causes a connection mechanism 26 of the tool to be forced backwards (in the direction of arrow A) via a connection part 22, thereby causing the motors 13, and their integral flywheels 17, to move closer together, as described below. An electrical switch (not shown) is located behind a front part 36 of the support 3, and the backwards movement of the connection mechanism 26 causes the switch to be closed, thereby actuating the motors 13 so that they rotate in opposite directions to each other, as indicated by arrows C and D.

With the nose part 14 in a retracted position, if the user then pulls the trigger 16, this causes the actuation of a solenoid 28 winch causes a kicker 30 to move forward (i.e. in the opposite direction to arrow A). This forward movement of the kicker 30 pushes (kicks) the driver 5 forward (in the opposite direction to arrow A) so that a front region of the driver passes between the two flywheels 17, and contacts the flywheels. Because the flywheels 17 are rotating in opposite directions such that at their closest points they are moving in the same direction (i.e. in the opposite direction to arrow A), when the driver 5 contacts the flywheels it is propelled forward by the flywheels toward the nose part 14, and drives (fires) a fastener (e.g. a nail) from the tool into the workpiece, To achieve this, the trigger 16 may be pulled before or after the nose part 14 is retracted, but if pulled before the nose part is retracted, the trigger must remain pulled while the nose part is retracted.

Each electric motor 13, and its integral flywheel 17, is mounted in a respective frame 19 which is attached to the support 3, and each frame 19 and its associated motor/flywheel 13/17 includes a sub-assembly 2. The frames 19 are pivotably attached to the support 3 by means of pivots 21, so that the motors 13 and their integral flywheels 17 may be moved (rotated) toward and away from each other. The pivots 21 are situated generally between the sub-assemblies 2, and thus generally between the flywheels 17, and when the flywheels 17 are closest together, the pivots 21 are situated closer to the nose part 14 than are the rotational axes 48 of the flywheels. The frames 19 of the sub-assemblies 2 are also attached to the connection mechanism 26, via pivots 32.

As described above, when the nose part 14 is retracted (i.e. moved backwards) with respect to the support 3, the connection mechanism 26 is forced backwards (in the direction of arrow A) by the lever 20. The forcing backwards of the connection mechanism 26 causes each frame 19 to pivot backwards about its pivot point 21 on the support 3, i.e. to rotate in the same direction (C or D) as the direction of rotation of their associated motor 13 in use. Thus, each sub-assembly 2, including frame 19 and associated motor 13 and flywheel 17 pivots backwards with respect to the support 3, and in so doing moves closer to the other sub-assembly 2, The flywheels 17 are thus moved toward each other, such that they are in an operative position in which the driver 5 is able to make contact with the flywheels to propel the driver (and the ram 7) forward, when the driver is kicked forward by the kicker 30.

When the nose part 14 is not pressed against a workpiece, its rest position is a non-retracted position. The nose part 14 and the connection mechanism 26 are biased into a non-retracted position by means of a tension spring 34 extending between a part of the connection mechanism 26 and a front part 36 of the support 3. Additionally, the two frames 19 which carry their respective motors 13 and flywheels 17 are biased into a pivoted forward position by means of tension springs 38, which extend between respective frames 19 and parts of the support 3. (In the embodiment of the invention shown in FIGS. 8 to 10, there is a single spring 38 extending between the two frames 19, which performs the same function of biasing the two frames—and thus their motors and flywheels—into a forward position.) In the Figures, the sub-assemblies 2 (i.e. the frames 19, motors 13 and flywheels 17) are shown in a retracted (operative) position, i.e. forced backwards from their rest position by the connection mechanism having been forced backwards. However, the nose part 14 is shown in a fully forward (non-retracted) position.

Figure 7:
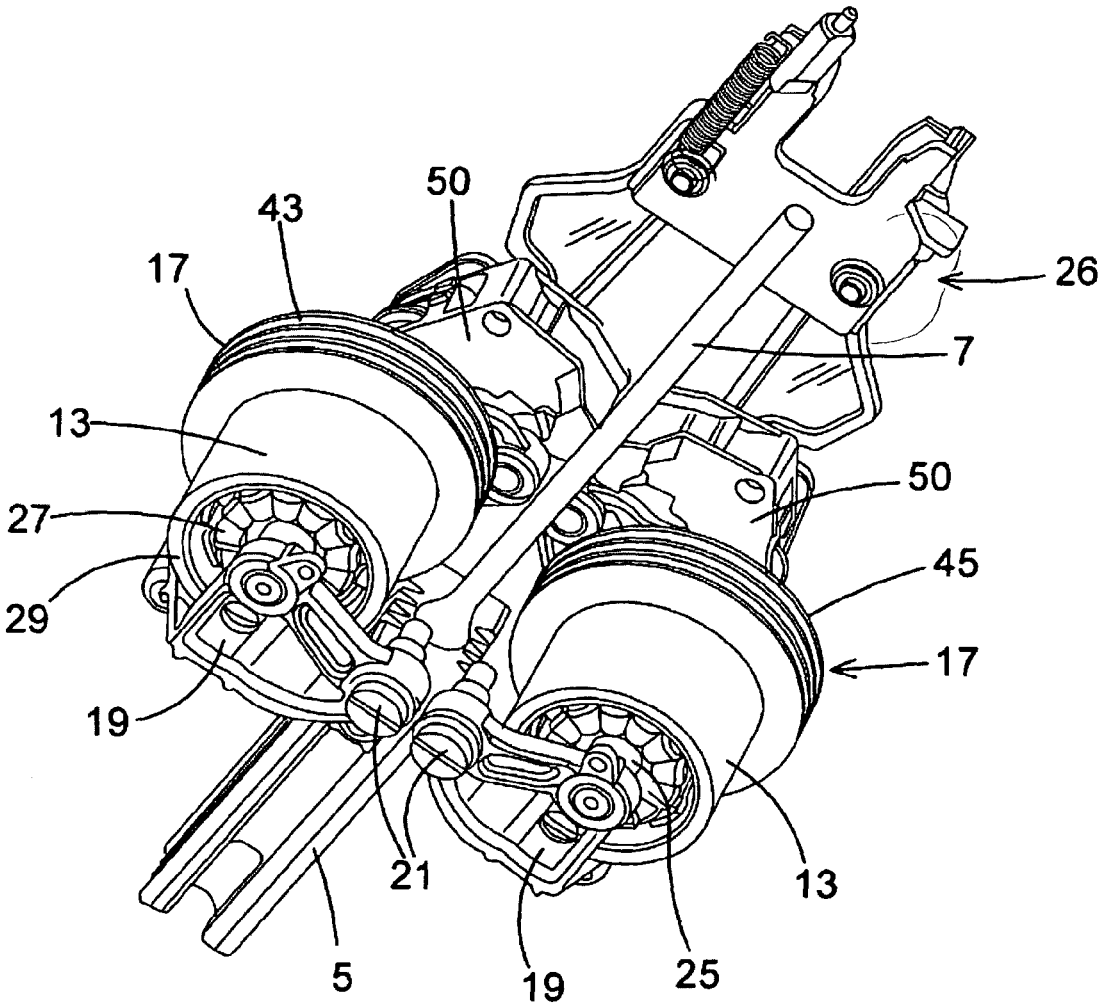

Each motor 13 is a brushless motor having a central stator 27 and an external rotor 29 arranged to rotate around the stator 27, the stator 27 being mounted on a non-rotational axial shaft 25 (see FIG. 7). The rotor 29 is rotationally mounted on two sets of bearings, both of which are mounted on the axial shaft 25 adjacent to the stator 27. The stator 27 includes a metal core, preferably steel having a generally cylindrical shape, with a plurality of stator poles projecting radially from a generally cylindrical centre portion. Each stator pole carries windings of electrical conductors (e.g. wires) in a manner disclosed in, for example as U.S. Pat. No. 4,882,511.

The rotor 29, which preferably is formed from metal, especially steel, includes the flywheel part 3 7, including an external part of the rotor having an increased outer diameter compared to the remainder of the rotor. As illustrated, the flywheel part 17 of the rotor 29 may either be formed integrally with the remainder of the rotor, apart from permanent magnets which need to be attached to the remainder of the rotor or the flywheel part may be separate and attached to the remainder of the rotor. In the embodiment of the invention illustrated, the flywheel part 17 of the rotor 29 includes a plurality of grooves 43 and ridges 45, each of which lies in a respective plane oriented perpendicular to the axis of rotation of the rotor 29, i.e. extending around the outer circumference of the rotor. The driver 5 has a plurality of ridges 47 and grooves 49 arranged longitudinally along at least part of the length of an external surface of the driver, arranged to engage with respective grooves 43 and ridges 45 of the flywheel. This inter-engagement of grooves and ridges on the flywheels 17 and the driver 5 increases the surface area of the contact between them, thus improving their fractional engagement, and also provides stabilizing guidance to the contact between the flywheels and the driver.

The connection mechanism 26, which operatively interconnects the nose part 14 with the sub-assemblies 2, including the flywheels 17, will now be described in greater detail. A front part 40 of the connection mechanism 26 is arranged to slide forward and backwards (i.e. toward and away from the nose part) on the support 3. Pivotally attached (at pivot points 42) to the front part 40 of the connection, mechanism 26 are two second parts 44 of the connection, mechanism. At the opposite end of each second part 44 to the front pivot points 42 are slots 46 which extend in approximately longitudinal (i.e. forward/backwards) orientations. Slidingly located in respective slots 46 are pivot pins 32 which pivotably connect respective first parts 50 of the connection mechanism to respective frames 19 (i.e. to respective sub-assemblies 2, including respective flywheels 17 and motors 13). Each first part 50 of the connection mechanism includes a projection 52 removably received in a recess or opening 54 in a respective second part 44 of the connection mechanism.

As already described, in order to drive (fire) a nail or other fastener from the tool into a workpiece, the user presses the nose part 14 of the tool against the workpiece so that the nose part 14 retracts (in the direction of arrow A) with respect to the support 3. The retraction of the nose part 14 causes the lever 20 to mechanically force the connection mechanism 26 backwards (in the direction of arrow A). The retraction of the nose part 14 and the backwards movement of the connection mechanism 26 also cause an electrical switch to be closed, thereby actuating the motors 13 and causing their integral flywheels 17 to rotate as indicated by arrows C and D. The front part 40 of the connection mechanism 26 is forced to slide backwards on the support 3, and this carries the two second parts 44 of the connection mechanism backwards with it. The second parts 44 are connected to respective frames 19 of the sub-assemblies 2 via respective first parts 50 of the connection mechanism. In particular, projections 52 of first parts 50 located in the recess or opening 54 in each second part 44 complete the operative interconnection between the nose part 14 and the frames 19 of the sub-assemblies 2, and thus between the nose part and the flywheels 17. Thus, the forcing backwards of the connection mechanism 26 also forces the sub-assemblies 2 backwards, pivoting the sub-assemblies, and thus the flywheels 17, with respect to the support 3 about pivot points 21, and thus moving the flywheels from an inoperative position in which the driver 5 cannot contact them, to an operative position in which the driver will contact and be propelled by the flywheels when it is kicked forward by the kicker 30 when the trigger 16 is pulled.

When the driver 5 is kicked forward toward the nose part 14 (as indicated by arrow E in FIG. 6) by the kicker 30 actuated by the trigger 16 and the solenoid 28, it moves toward a gap 56 between the rotating flywheels 17 and contacts both flywheels because the gap between them is now no larger than and preferably slightly smaller than the width of the driver. When the driver 5 contacts the rotating flywheels 17, the flywheels grip the driver and propel it forward at high speed toward the nose part 14, so that the ram 7 attached to the front of the driver drives (fires) a nail or other fastener from the tool 1. However, before the driver/ram fires a fastener from the tool, the driver impacts with the two rotatable first parts 50 of the connection mechanism 26, and, in particular, with resilient parts 51 which help to cushion the impact, causing the two first parts 50 to rotate about pivots 32 relative to the two second, parts 44 (as indicated by arrows F), thereby forcing the two projections 52 out of the recesses or openings 54 (as indicated by arrows G). By virtue of the bias provided by the tension springs 38 and because the first parts 50 of the connection mechanism 26 are slidably attached to the second parts 44 in slots 46, the sub-assemblies pivot forward in the opposite directions to directions C and D (as indicated by arrows H and I) once they are able to do so, i.e. once the driver 5 has been propelled clear of the flywheels 17. In particular, the bias provided by the tension springs 38 causes the sub-assemblies 2 to pivot forward and away from each other (as indicated by arrows H and I), thereby causing the pivot pins 32 of the first parts 50 to move forward in respective slots 46 of the second parts 44 (as indicated by arrows J) and causing the projections 52 of the first parts 50 to move out of the recesses or openings 54 and to move forward relative to the second parts 44 (as indicated by arrows G). Thus, the forward movement of the driver 5 guided and propelled by the flywheels 17 toward the nose part, causes the operative interconnection between the nose part and the flywheels to be broken.

The movement of the sub-assemblies 2 forward and away from each other, caused by the forward movement of the driver 5, causes the flywheels 17 to move from their operative position to their inoperative position. This means that when the driver 5 has driven a fastener from the tool, it is able to pass back between the flywheels 17 without hindrance (i.e. without touching the flywheels), so that it is returned to its original starting position, ready for the next fastener to be driven from the tool. The driver 5 is returned to its starting position by means of an elongate elastic member 60, one end of which is attached to the driver, and which extends around a rotatable wheel 62 at the rear of the support 3, the opposite end of the elastic member being attached to the support 3 forwardly of the wheel 62. This is shown more clearly in FIGS. 8 to 10, which also show a helical spring 64 which acts in conjunction with the elongate elastic member 60 to return the driver 5 to its original starting position behind the flywheels 17.

The flywheels 17, and, of course, the entire subs-assemblies 2, cannot be returned from their inoperative positions to their operative positions until the operative interconnection between the nose part 14 and the flywheels 17 is re-formed. As described above, this operative interconnection requires the projections 52 of the first parts 50 of the connection, mechanism 26 being located in recesses or openings 54 in the second parts 44 of the connection mechanism, and because of the bias provided by the springs 38, this cannot happen until the nose part 14 and the second parts 44 of the connection mechanism 26 move forward under the influence of the spring 34 relative to the support 3. Thus, after a fastener has been driven/fired from the tool 1, the operative interconnection between the nose part 14 and the flywheels 17 is re-formed only when the nose part of the tool is lifted from the workpiece, allowing it to move forward relative to the support 3. This mechanism is intended to prevent the firing of a fastener directly onto a fastener already driven into the workpiece.

Figure 8:
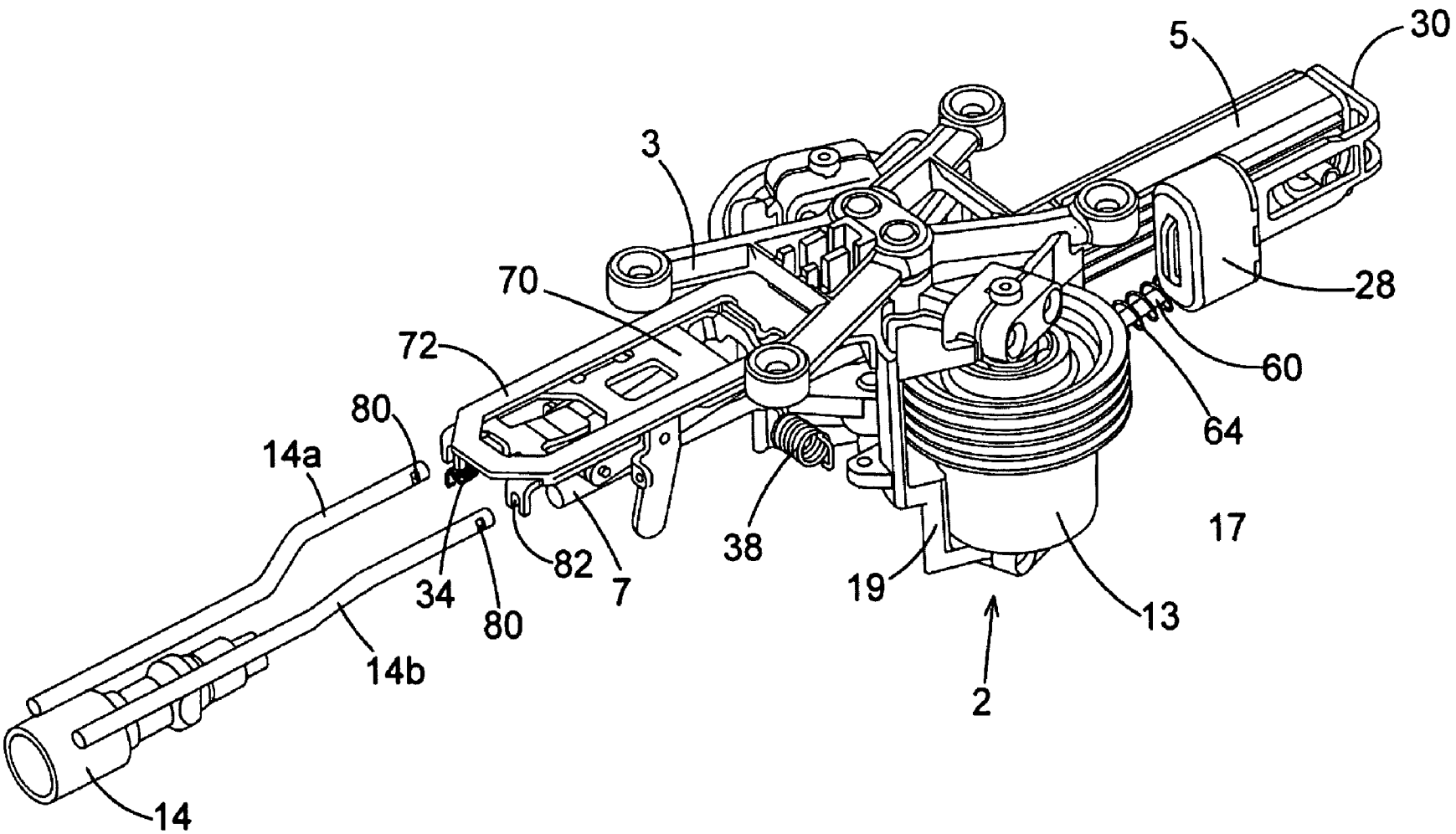
FIGS. 8 to 10 show a second embodiment of a fastener driving tool according to the invention, and components thereof.
Figure 9:
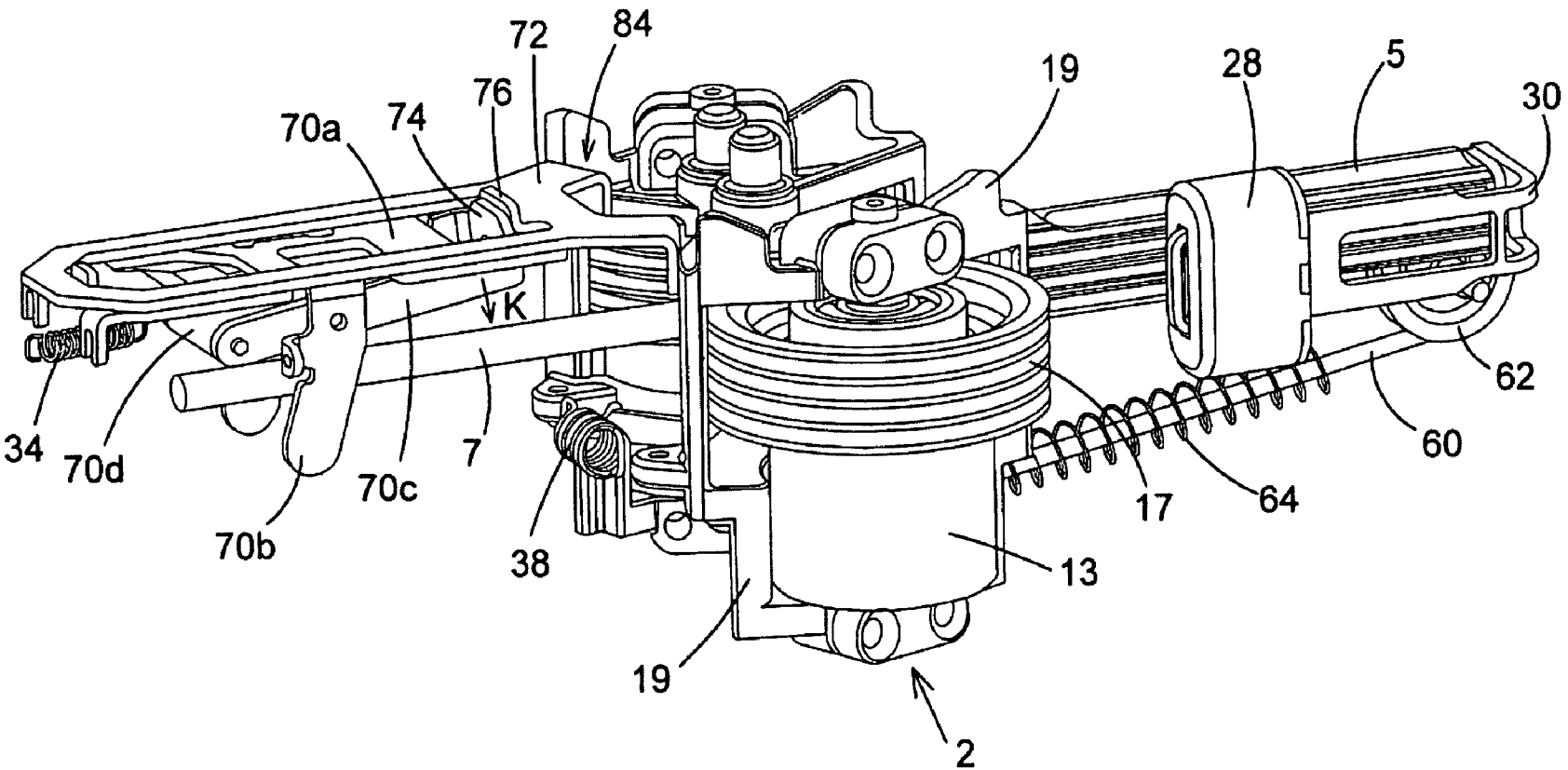
Figure 10:
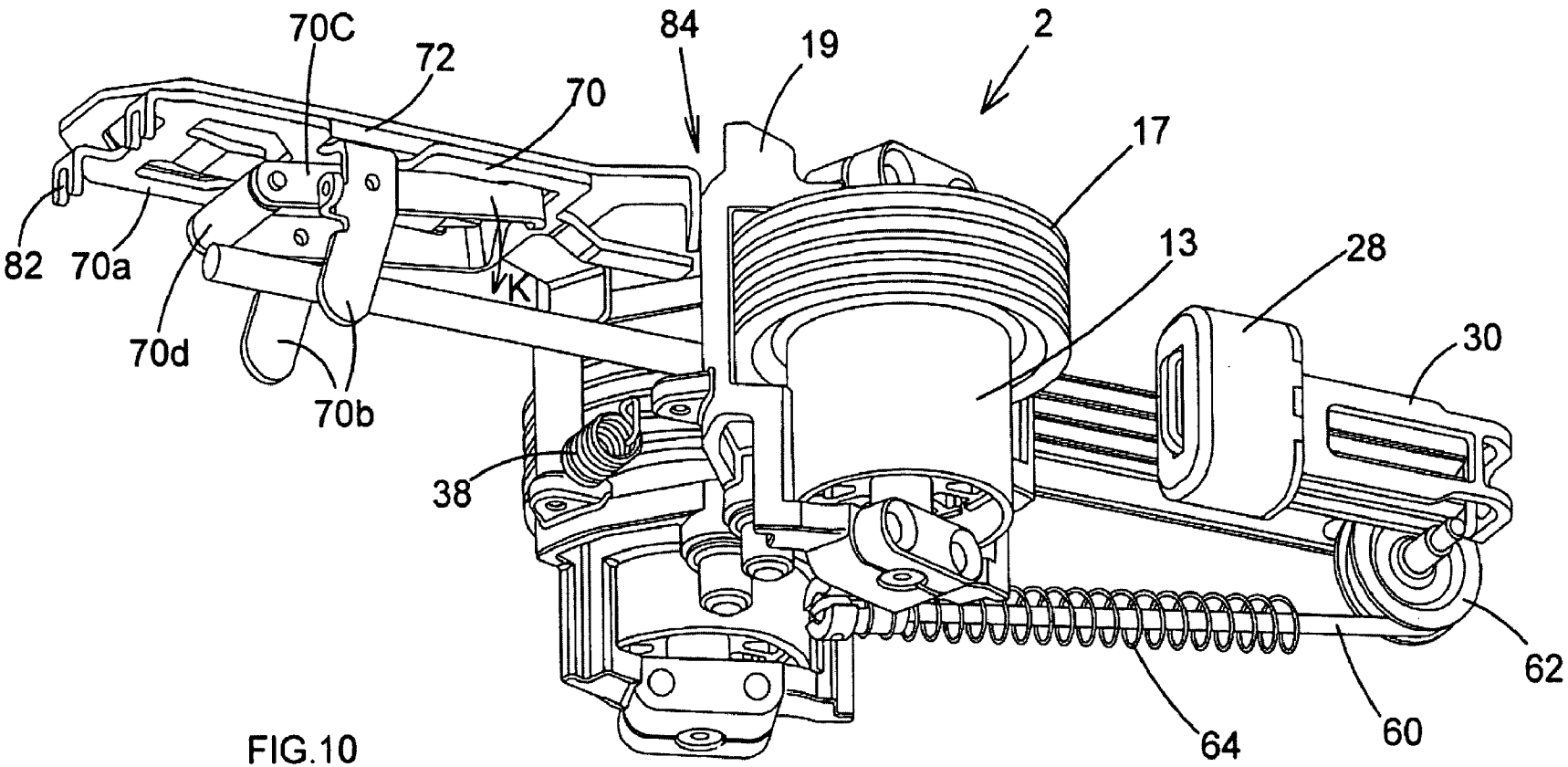

FIGS. 8 to 10 show a second embodiment of a fastener driving tool according to the invention, and components thereof, with like components given like reference numerals. The notable difference between this embodiment of the invention and the embodiment shown in FIGS. 7 to 9, is the configuration of the first and second parts of the connection mechanism 26. In this embodiment, the first and second parts of the connection mechanism 26 are plate-like parts 70 and 72, respectively. The first part 70 includes a main plate-like part 70*a*, a pair of extension parts 70*b*, a pivoting part 70*c*, and a roller part 70*d*. The pivoting part 70*c* is pivotably attached to the extension parts 70*b*, which extend from the main plate-like part 70*a*. The roller part 70*d* is rotationally attached to a forward region of the pivoting part 70*c*. The first part 70 of the connection mechanism 26 is in sliding engagement with the second part 72 of the connection mechanism.

In use, when there is an operative interconnection between the nose part 14 and the flywheels 17, the first part 70 of the connection mechanism 26 is in abutting engagement with the second part 72 of the connection mechanism, via protrusions 74 and 76 on the first and second parts, respectively. In particular, the protrusion 74 includes a portion of the pivoting part 70*c* of the first part of the connection mechanism, the protrusion 76 includes a portion of the second part 72 of the connection mechanism, and the pivoting part 70*c* of the first part 70 is biased (e.g. by a spring member, not shown) to adopt the abutting engagement with the second part 72. Thus, when the nose part 14 is retracted, the elongate parts 14*a* and 14*b* (which are attached to part 70*a* via grooves 80 and notches 82) force the plate-like part 70*a* backwards, and because of the abutting engagement between the protrusions 74 and 76, this also forces the plate-like part 72 backwards. This, in turn, forces the sub-assemblies 2 backwards, by means of an abutting engagement 84 between the plate-like part 72 and the frames 19 of the sub-assemblies. Thus, the flywheels 17 are forced backwards and closer together, into their operative position.

Subsequently, when the driver 5 is propelled forward toward the nose part 14 by the flywheels 17, a front region of the driver impacts the roller part 70*d* of the pivoting part 70*c* of the connection mechanism, causing the pivoting part 70*c* of the first part 70 to pivot relative to the second part 72, as indicated by arrow K. The pivoting of the pivoting part 70*c* causes the abutting engagement between the protrusions 74 and 76 of the first and second parts of the connection mechanism to be broken. Also, the sub-assemblies 2 pivot forward and away from each other under the influence of the tension spring 38, thereby causing the second part 72 of the connection mechanism. 26 to move forward relative to the first part 70 of the connection mechanism. This means that the abutting engagement between the protrusions 74 and 76 cannot be re-formed, despite the bias of the pivoting part. Consequently, the operative interconnection between the nose part and the flywheels is broken by the forward movement of the driver 5 guided and propelled by the flywheels 17 toward the nose part.

The movement of the sub-assemblies 2 forward and away from each other, caused by the forward movement of the driver 5, causes the flywheels 17 to move from their operative position to their inoperative position. This means that when the driver 5 has driven a fastener from the tool, it is able to pass back between the flywheels 17 without hindrance (i.e. without touching the flywheels), so that it is returned to its original starting position, ready for the next fastener to be driven from the tool. The driver 5 is returned, to its starting position by means of the elongate elastic member 60 (e.g. formed from elastomeric material) and the helical spring 64, which pull the driver backwards once it has fired a fastener from the tool.

The operative interconnection can be re-formed only when the nose part 14 of the tool is lifted from the workpiece, allowing it to move forward relative to the support 3 (under the influence of spring 34), thereby moving the first part 70 of the connection mechanism 26 forward relative to the second part 72, and thus causing the abutting engagement between the protrusions 74 and 76 to be re-formed.

It will be understood that the above description and the drawings are of particular examples of the invention, but that other examples of the invention are included in the scope of the claims.

We claim:

1. A fastener driving tool, comprising:

a support;

at least one wheel movably mounted on the support;

a driver arranged to contact and be guided by the wheel when the wheel is in an operative position in use;

a nose part retractable relative to the support; and a connection mechanism to operatively interconnect the nose part with the wheel, wherein the tool is arranged such that, in use, the retraction of the nose part causes the connection mechanism to move the at least one wheel from an inoperative position to the operative position, and subsequent forward movement of the driver guided by the at least one wheel toward the nose part causes the operative interconnection between the nose part and the at least one wheel to be broken, and wherein the connection mechanism comprises at least first and second parts arranged such that when the connection mechanism provides the operative interconnection between the nose part and the at least one wheel, the first and second parts are directly or indirectly in engagement with each other, and when the operative interconnection is broken, the first and second parts are disengaged from each other.

2. The tool according to claim 1, wherein the at least one wheel comprises a flywheel arranged to propel the driver toward the nose part, to drive a fastener from the tool into a workpiece.

3. The tool according to claim 2, further comprising at least one motor arranged to power the flywheel.

4. The tool according to claim 3, wherein each flywheel is powered by a respective motor, and each flywheel and associated motor is mounted on a respective frame which is movably mounted on the support, the motor, flywheel and frame comprising a sub-assembly, and the movement of the flywheel between inoperative and operative positions comprises movement of the sub-assembly with respect to the support.

5. The tool according to claim 1, wherein the at least one wheel is pivotally mounted on the support, and the movement of the at least one wheel from its inoperative position to the operative position comprises pivoting movement with respect to the support.

6. The tool according to claim 1, arranged such that the breaking of the operative interconnection between the nose part and the at least one wheel causes or allows the at least one wheel to be moved from the operative position to the inoperative position.

7. The tool according to claim 6, further comprising at least one resilient member arranged to cause the at least one wheel to be moved from the operative position to the inoperative position when the operative interconnection between the nose part and the at least one wheel is broken.

8. The tool according to claim 6, wherein the driver is arranged to return to a starting position after it has driven a fastener from the tool, and the movement of the at least one wheel from the operative position to the inoperative position allows the driver to return to the starting position substantially without touching the at least one wheel.

9. The tool according to claim 1, arranged such that the first and second parts are disengaged from each other, in use, by the driver forcing the first and second parts to become disengaged by virtue of the forward movement of the driver.

10. The tool according to claim 9, wherein the driver is arranged to impact at least a portion of the first part of the connection mechanism during the forward movement of the driver, thereby disengaging the first part from the second part.

11. The tool according to claim 10, wherein at least the portion of the first part of the connection mechanism is arranged to move relative to the second part when impacted by the driver.

12. The tool according to claim 11, wherein at least the portion of the first part of the connection mechanism is arranged to rotate relative to the second part when impacted by the driver.

13. The tool according to claim 1, arranged such that the engagement between the first and second parts of the connection mechanism comprises at least a component of one of the first and second parts being located in a recess or opening in the other of the first and second parts.

14. The tool according to claim 13, wherein the disengagement of the first and second parts comprises the component of one of the first and second parts not being located in the recess or opening in the other of the first and second parts.

15. The tool according to claim 1, comprising two sets of first and second parts of the connection mechanism.

16. The tool according to claim 1, wherein the at least one wheel is rotationally mounted on a respective frame, the frame movably mounted on the support.

17. The tool according to claim 1, comprising a pair of wheels arranged such that the driver contacts and passes between the pair of wheels during a forward movement toward the nose part when the pair of wheels are in an operative position in use.

18. The tool according to claim 17, wherein a movement of the pair of wheels from the operative position to the inoperative position allows the driver to return to its starting position by passing back between the pair of wheels.

19. The tool according to claim 1, arranged such that forward movement of the nose part relative to the support, subsequent to the operative interconnection between the nose part and the at least one wheel being broken, causes the operative interconnection between the nose part and the at least one wheel to be re-formed.

20. The tool according to claim 19, further comprising at least one resilient part arranged to move the first and/or second part of the connection mechanism to a rest position when the nose part moves forward, thereby re-engaging the first and second parts with each other.

21. A fastener driving tool, comprising:

a support;

at least one wheel movably mounted on the support;

a driver arranged to contact and be guided by the at least one wheel when the at least one wheel is in an operative position in use;

a nose part retractable relative to the support; and a connection mechanism to operatively interconnect the nose part with the at least one wheel; the connection mechanism having an operative mode wherein the nose part and the at least one wheel are operatively interconnected, and an inoperative mode wherein the nose part and the at least one wheel are not operatively interconnected, wherein the tool is arranged such that, when the connection mechanism is in the inoperative mode and the nose part is retracted, forward movement of the nose part away from the support causes the connection mechanism to adopt its operative mode, and wherein the connection mechanism comprises at least first and second parts arranged such that when the connection mechanism is in the operative mode, the first and second parts are directly or indirectly in engagement with each other, and when the connection mechanism is in the inoperative mode, the first and second parts are disengaged from each other.

22. The tool according to claim 21, further comprising at least one resilient part arranged to move at least one of the first and second parts of the connection mechanism to a rest position when the nose part moves forward, thereby re-engaging the first and second parts with each other.

* * * * *